United States Patent [19]

Wilde

[11] Patent Number: 4,923,073

[45] Date of Patent: May 8, 1990

[54] TAMPER-INDICATING PLASTIC CLOSURE

[75] Inventor: Sheldon L. Wilde, Crawfordsville, Ind.

[73] Assignee: H-C Industries, Inc., Crawfordsville, Ind.

[21] Appl. No.: 303,317

[22] Filed: Jan. 30, 1989

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,147,268 | 4/1979 | Patel et al. | 215/252 |
| 4,156,490 | 5/1979 | Peraboni | 215/252 |
| 4,278,180 | 7/1981 | Willis | 215/252 |
| 4,418,828 | 12/1982 | Wilde et al. | 215/252 |
| 4,436,212 | 3/1984 | Alejandro Llera | 215/252 |
| 4,497,765 | 2/1985 | Wilde et al. | 215/252 X |
| 4,597,241 | 4/1986 | Hayes | 215/252 |
| 4,666,053 | 5/1987 | Corcoran et al. | 215/252 |
| 4,720,018 | 1/1988 | Schetzsle et al. | 215/252 |
| 4,756,438 | 7/1988 | Ryder | 215/252 |

FOREIGN PATENT DOCUMENTS

| | | | |
|---|---|---|---|
| 2314864 | 10/1974 | Fed. Rep. of Germany . | |
| 3144924 | 5/1983 | Fed. Rep. of Germany | 215/252 |

*Primary Examiner*—Donald F. Norton

*Attorney, Agent, or Firm*—Dressler, Goldsmith, Shore, Sutker & Milnamow, Ltd.

[57] ABSTRACT

A tamper-indicating plastic closure is shown which is configured for mechanical interference with the annular locking ring of an associated container. The closure includes a top wall portion and depending skirt portion, with a circular pilfer band at least partially detachably connected to the skirt portion by a plurality of circumferentially spaced fracturable bridges. Notably, the pilfer band includes an internal, annular interference lip which is skewed or arranged at an angle relative to the vertical axis of the closure. By this construction, the interference lip engages the container locking ring during closure application so as to deform the closure to a non-circular configuration, thus minimizing stressing of the fracturable bridges. During closure removal, the angular configuration of the interference lip creates localized stressing of the fracturable bridges, thus providing serial fracture of the bridges.

16 Claims, 2 Drawing Sheets

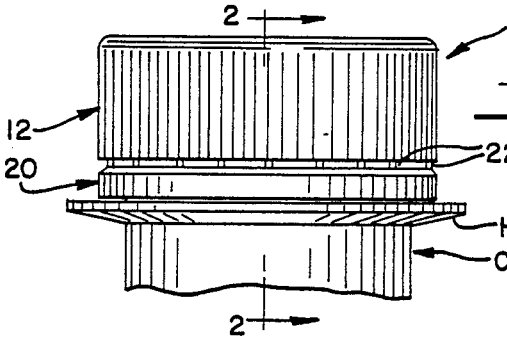
FIG. 1
FIG. 2
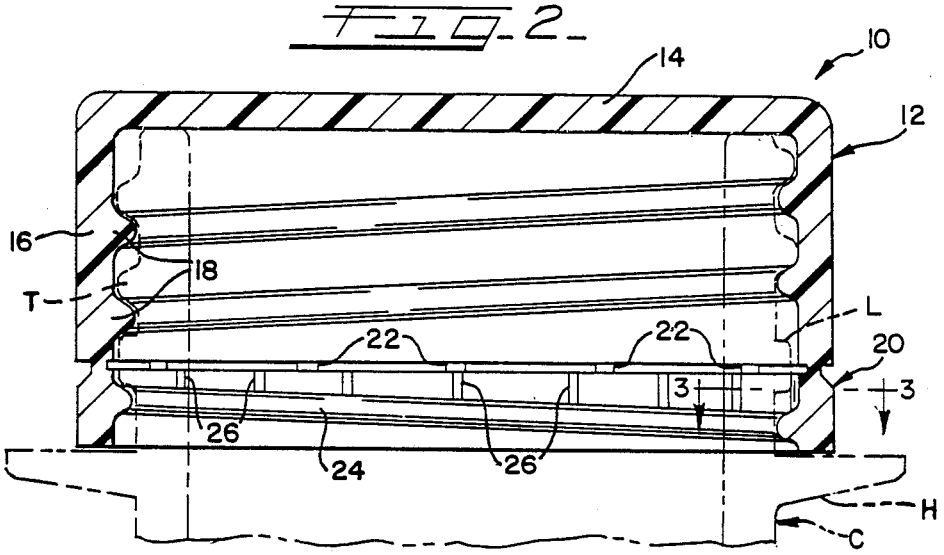
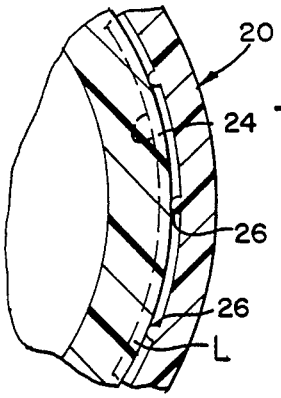
FIG. 3

TAMPER-INDICATING PLASTIC CLOSURE

Technical Field

The present invention relates generally to tamper-indicating closures for containers, and more particularly to a tamper-indicating plastic closure including a pilfer band having an internal interference lip arranged in skewed relationship to the vertical axis of the closure.

BACKGROUND OF THE INVENTION

The provision of tamper-indicating or tamper-evident closures for containers is desirable for all manner of consumer products, so that partial or complete removal of the closure results in clearly discernible visible alteration thereof. Typically, closures of this nature include an upper cap portion, and a depending pilfer band arranged to interact and cooperate with the container to which the closure is applied. The pilfer band is typically configured so as to fracture and/or separate from the closure cap attendant to closure removal, thereby providing clearly discernible evidence that the container has been opened.

Various techniques are known for effecting the desired interaction of a closure pilfer band with the associated container. For example, the pilfer band may be deformed after application to the container to achieve the desired interaction, such as is the case with so-called roll-on metallic closures. A similar interaction is achieved with so-called heat-shrink plastic closures, wherein the closure includes a heat-shrinkable pilfer band which is heat-shrunk into a configuration for tamper-indicating interaction with the container subsequent to application thereto. Other arrangements, such as disclosed in commonly-assigned U.S. Pat. No. 4,418,828, to Wilde et al., include pilfer bands having flexible elements which move to an out-of-the-way disposition during application of the closure to the container, with the flexible elements thereafter cooperating with the container to provide the desired tamper-indicating function.

Another type of tamper-indicating closure includes so-called interference-type pilfer bands. For use of such arrangements, the container includes an annular, bead-like external locking ring on the neck portion thereof, ordinarily positioned just beneath an external thread formation on the container neck. The pilfer band of the closure in turn includes a pilfer band having an internal ledge, lip, bead, or like projection or projections intended to cooperate with the container locking ring for tamper-indication. Specifically, the pilfer band is configured to move past and generally beneath the container locking ring during application of the closure to the container, with the inner projection of the pilfer band dimensioned so as to interferingly engage the container locking ring after the closure is fully fitted to the container. During removal, this mechanical interference between the pilfer band and the locking ring creates stress on the closure, which is typically configured for fracture of the pilfer band, and/or fracturable separation of the pilfer band from the upper cap portion of the closure.

Design of consistently reliable interference-type tamper-indicating closures can be problematical. As will be appreciated, it is of utmost importance that a tamper-indicating closure be capable of withstanding the stresses during application without failure (ordinarily during application by high-speed capping equipment), while at the same time fracturing in the intended manner reliably and predictably during closure removal. These ends must be achieved while recognizing that both closures and containers are subject to normal manufacturing tolerances, which can, of course, result in a relatively "large" closure (within tolerances) being fitted to a relatively "small" container, or vice versa.

In the past, these design considerations have complicated development of effective interference-type closures. During application, the interfering element of the closure pilfer band, which is typically arranged perpendicularly to the axis of the closure, engages the container locking ring generally completely about the circumference of the closure. Since the closure must deform outwardly to clear and "snap over" the locking ring, relatively great force is required for application. The fracturable components of the closure are subjected to this stress, and must be capable of withstanding it without failure.

Proper function of the closure further requires that the fracturable components fracture reliably during closure removal. This can be difficult to achieve, since during removal, the typically perpendicular interference element of the pilfer band engages the container locking ring so that the stress that is generated is typically equally distributed about the circumference of the closure. Thus, this fracturing stress is generally equally distributed to fracturable elements or the like connecting the pilfer band and closure cap.

Since no one or group of such fracturable elements are preferentially stressed during removal, a relatively great interference force must be created to assure fracture. However, in a typical construction, the greater the interference, the greater the forces that are created during closure application, thus requiring stronger" fracturable components, which require greater interference stresses during removal, etc.

The present invention contemplates an interference-type tamper-indicating closure which is specifically configured to overcome these problems by deforming the pilfer band during closure application to minimize stresses which are created, and thereafter selectively and progressively stressing the fracturable components of the closure to provide consistent, reliable tamper-indication.

SUMMARY OF THE INVENTION

The tamper-indicating plastic closure embodying the principles of the present invention is of the so-called interference-type, and includes a pilfer band configured to mechanically interfere with an annular locking ring or like component of an associated container. Notably, in distinction from typical previous constructions, the closure pilfer band includes an internal interference lip which is skewed at an acute angle relative to the vertical axis of the closure. By this construction, the pilfer band is deformed to an out-of-round or non-circular configuration during application to the container, thus reducing the required application force and resultant stresses, with the pilfer band further functioning during closure removal to provide a progressive stressing of the fracturable connection between the pilfer band and the remainder of the closure.

In the illustrated embodiment, the present closure includes an upper closure cap including a circular top wall portion, and a depending, generally cylindrical skirt portion having an internal thread formation. The closure further includes a circular or annular pilfer band depending from the cylindrical skirt portion, with the pilfer band at least partially detachably connected to the skirt portion by a plurality of circumferentially spaced fracturable bridges.

In accordance with the present invention, the pilfer band includes an annular interference lip which extends circumferentially about the inner surface of the pilfer band, with the interference lip being engageable with an annular, external locking ring or like element of an associated container.

Notably, the interference lip is arranged at a skewed, non-perpendicular disposition relative to the vertical axis of the closure, preferably at an acute angle in the range of about one to five degrees. As a consequence, the interference lip does not engage the container locking ring in face-to-face relationship about the circumference of each, but rather, in a progressive manner so that only a selected portion or portions of the interference lip engage the locking ring at any one time. By this action, engagement of the interference lip with the locking ring during application of the closure to the container deforms the pilfer band to a non-circular, generally elliptical or oval configuration. This limited deformation reduces the force required for applying the closure to the container, thereby minimizing the stress exerted on the fracturable bridges connecting the pilfer band to the skirt portion of the closure cap. At the same time, the skewed orientation of the interference lip permits the closure to be configured for relatively greater interference with the container, for a given application force.

During removal, the skewed interference lip functions to selectively, progressively stress the fracturable bridges, in a direction circumferentially of the closure, so that the bridges serially fracture. Just as during closure application, the skewed configuration of the interference lip results in it initially engaging the container locking ring at a distinct, limited portion of the interference lip, rather than about its circumference. In this manner, stresses created on the fracturable bridges are localized, thus resulting in one or more selected ones of the bridges initially fracturing. As closure removal continues, the bridges are stressed in a progressive manner, one or two at a time, so as to provide a serial fracture of the bridges. Thus, consistent and reliable fracture for tamper-indication is assured.

Other features and advantages of the present invention will become readily apparent from the following detailed description, the accompanying drawings, and the appended claims.

BRIEF DESCRIPTION OF THE DRAWINGS

FIG. 1 is a side elevational view of the present tamper-indicating plastic closure shown fitted to the neck portion of an associated container;

FIG. 2 is a cross-sectional view taken along lines 2—2 of FIG. 1 further illustrating the present tamper-indicating closure fitted to the container;

FIG. 3 is a fragmentary cross-sectional view taken along lines 3—3 of FIG. 2;

DETAILED DESCRIPTION

Figure 4:
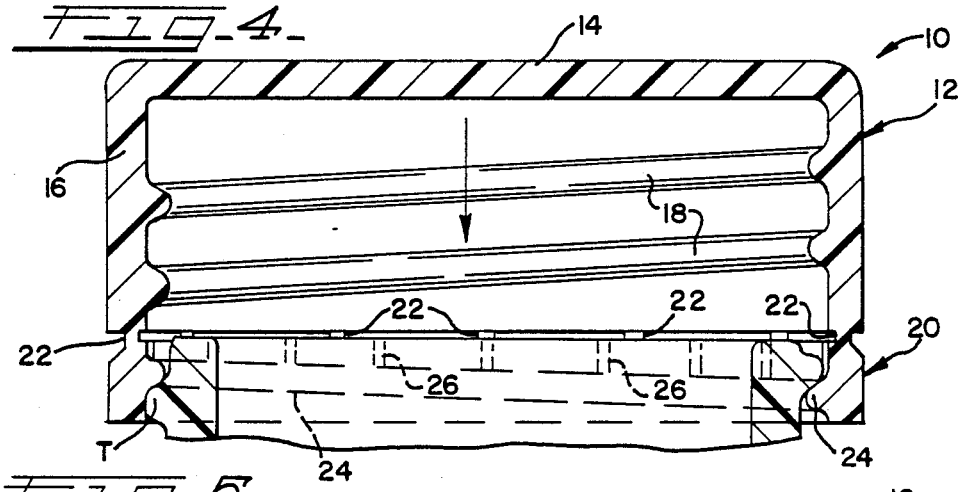
FIG. 4 is a cross-sectional view similar to FIG. 2 illustrating application of the present closure to the associated container.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With particular reference to FIGS. 1 and 2, therein is illustrated a tamper-indicating plastic closure 10 embodying the principles of the present invention. As will be further described, closure 10 is of the so-called interference-type, and is configured for mechanical interference with an associated container C during removal of the closure therefrom for providing the desired visible alteration of the closure for tamper-indication. To this end, the container C includes an annular, external bead-like locking ring L which extends circumferentially of the neck portion of the container perpendicularly to the vertical axis thereof. As in a typical arrangement, locking ring L is illustrated as being positioned just beneath external container threads T, with the container C further illustrated as including a typical hand grip or handle H.

The closure 10 includes an upper, cup-like closure cap 12 having a circular top wall portion 14, and a depending annular or cylindrical skirt portion 16. Skirt portion 16 preferably includes an internal thread formation 18. Depending upon the specific use of the closure, a sealing liner or like sealing means can be provided, typically at the inside surface of top wall portion 14.

In accordance with the present invention, closure 10 includes an annular pilfer band 20 depending from skirt portion 16 of closure cap 12. In the illustrated embodiment, pilfer band 20 is at least partially detachably connected to the skirt portion 16 by a plurality of circumferentially spaced apart fracturable bridges 22. The specific arrangement of fracturable bridges 22 can be varied while keeping with the principles disclosed herein. While bridges 22 are illustrated as being positioned generally within the vertical confines of skirt portion 16 and pilfer band 20, the bridges 22 may alternately be provided in other forms. For example, the fracturable bridges can be provided generally along the inner surfaces of the pilfer band and skirt portion, such as disclosed in commonly-assigned U.S. Pat. No. 4,418,828. When the bridges are provided on the inside surfaces of the skirt portion and pilfer band in this manner, a circumferentially extending score line is preferably provided which otherwise separates and distinguishes the skirt portion and pilfer band from each other, with the inwardly positioned bridges providing the desired fracturable connection.

As will also be noted, the illustrated fracturable bridges 22 are of uniform size, and thus of a generally uniform strength. If desired, the bridges 22 can be of a non-uniform size and strength, and positioned other than equally circumferentially spaced about the closure. Such alternate configurations can be desirable in view of the manner in which the pilfer band of the present invention selectively and progressively stresses the bridges during removal of the closure from the associated container for tamper-indication.

In accordance with the present invention, pilfer band 20 includes an annular, bead-like interference lip 24 extending circumferentially about the inner surface of pilfer band 20. Notably, interference lip 24 does not extend perpendicularly to the vertical axis of closure 10, but rather extends in a plane arranged at an acute angle relative to the vertical axis of the closure. In the preferred form, the plane within which the lip 24 extends is arranged at an acute angle in the range of about one degree to about five degrees relative to the closure axis.

In the illustrated embodiment, the interference lip 24 is shown as extending continuously about the inner surface of the pilfer band 20. However, it should be recognized that the interference lip 24 may be otherwise configured, so as to extend discontinuously about the inner surface of the pilfer band such as by the provision of a series of segments, lugs, or like projections. Whether the interference lip is of a continuous or discontinuous configuration, the present invention contemplates that the lip extends in a skewed or non-perpendicular relationship to the vertical axis of the closure.

The significance of this angular disposition of interference lip 24 can be readily appreciated with consideration of simple geometric relationships. Bearing in mind that the interference lip 24 is intended to engage and cooperate with annular locking ring L on container C, each of the interference lip and locking ring can generally be considered to be as circular. In a typical interference-type closure, wherein the interference projection of the closure is perpendicular to the closure axis, the interference arrangement provided is in the nature of two parallel circles of similar diameter; fully circular, face-to-face engagement of the interference projection and locking ring results.

In distinction, the present arrangement is analogous to arranging two circles, of similar diameter, coaxially, but at an angle. Thus, as one circle passes through the other, intersection takes place initially at a point, then at two progressively moving points, and terminates at a final point diametrically opposed to the initial point of intersection. As a result of this non-circular engagement between the interference lip 24 and the annular container locking ring L, stresses created on the closure, attendant to both application and removal, are non-uniform about the circumference of the closure. Thus, the closure is selectively stressed in a non-uniform manner.

FIG. 4 illustrates initial application of closure 10 to container C. During application of the closure to the container C, the above-described non-uniform stressing desirably results in deformation of the pilfer band 20 to an out-of-round, non-circular configuration i.e., to a generally elliptical or oval shape. This deformation of the pilfer band facilitates movement of the interference lip 24 past the locking ring L during application of the closure to the container, thereby reducing the force required for application, and minimizing stresses created on the fracturable bridges 22. In effect, for a given application force, a greater interference can be achieved between the closure pilfer band and the container locking ring if they are relatively skewed than if they are arranged parallel (i.e., each perpendicular to the respective vertical axes of the closure and container).

Figure 5:
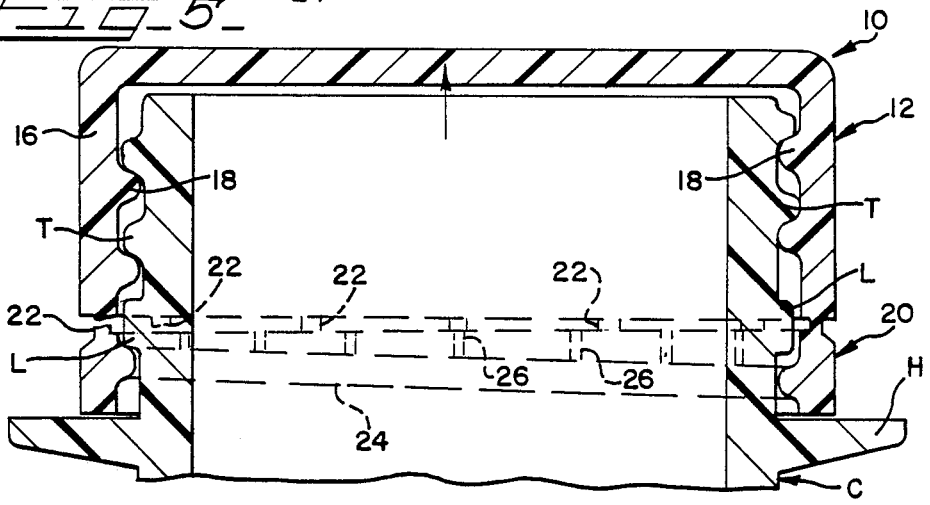
FIGS. 5 and 6 are cross-sectional views similar to FIG. 2 illustrating removal of the present tamper-indicating closure from the associated container.
Figure 6:
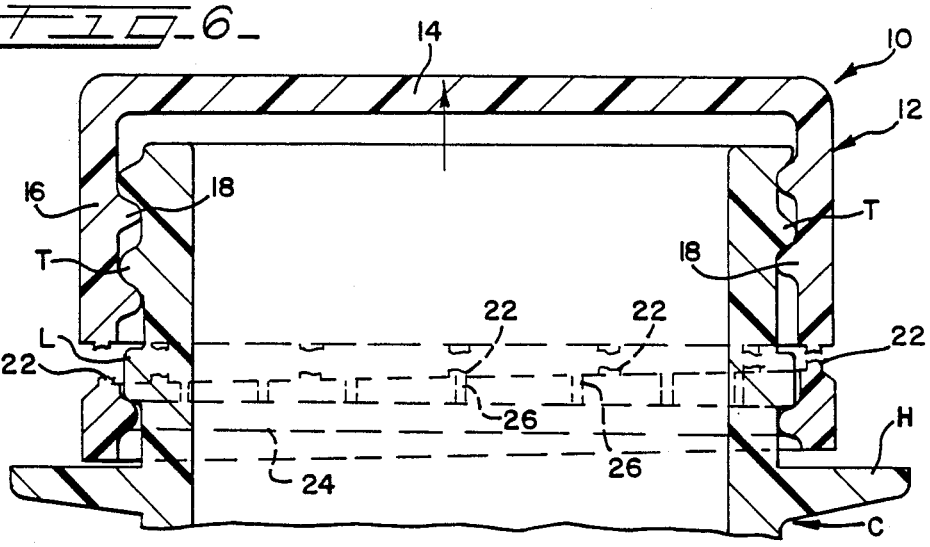

FIG. 5 illustrates initiation of removal of closure 10 from container C. Notably, the skewed interference lip 24 again cooperates with the container locking ring L to create a non-uniform stressing of the pilfer band 20, and in particular, provides a progressive stressing of fracturable bridges 22. During closure removal, that portion of the interference lip 24 closest to the top wall portion 12 of the closure first engages the locking ring L of the container (generally at the left-hand side of FIG. 5). Thus, forces exerted on the fracturable connection between the pilfer band and the skirt portion are localized in the region of this initial engagement of the lip 24 with the locking ring. In this manner, a progressive failure of the bridges 22 can be induced, as illustrated in FIG. 5.

As removal continues, the skewed or angular nature of interference lip 24 continues to create localized stressing of the pilfer band. Thus, bridges 24 serially fracture as the closure is removed from the container. Because the specific order in which the bridges 22 are likely to fracture is predetermined by virtue of the angular lip 24, the bridges 24 can be of non-uniform strengths (by configuring them of non-uniform cross-sectional areas), thus optimizing the desired fracturing for tamper-indication. When bridges 22 are of uniform strength, serial fracture of the bridges progresses circumferentially generally along opposed semi-circular portions of the closure from the point of initial fracture, with one or two of the bridges 22 failing at a time.

If complete separation of pilfer band 20 from closure cap 12 is desired, all of bridges 22 are configured for fracture, with the pilfer band 20 thus typically remaining in place on the container. However, if the pilfer band is to remain attached to the cap portion, one or more of the bridges can be configured for non-fracture, or a suitable non-fracturable connector portion provided. In such an arrangement, pilfer band 20 can be configured to define one or more preferentially weakened areas, whereby the pilfer band can split and fracture from its continuous annular configuration, and be removed from the container with the rest of the closure construction.

As noted, the manner in which the interference lip 24 engages the locking ring L during closure removal is generally in the nature of the engagement which occurs during application of the closure to the container. In view of this, it is desirable to provide means for preventing the pilfer band 20 from assuming a non-circular, i.e., oval, configuration, and thereby prevent the interference lip 24 from slipping over the locking ring L without failure of the bridges 22. To this end, the illustrated embodiment includes a plurality of circumferentially spaced centering ribs 26 on the inside surface of the pilfer band 20 above the interference lip 24. Centering ribs 26 are positioned to engage the container locking ring L during closure removal, and thus maintain the pilfer band in a circular configuration.

As will be appreciated, other suitable forms of centering means can be employed, such as by the provision of a continuous ring on the interior of the closure, or by the provision of an area of relatively reduced inside diameter just above the interference lip 24. In essence, it is contemplated that a centering arrangement be provided for engagement with the locking ring L as the interference lip 24 engages the locking ring, to thereby prevent the pilfer band from assuming a non-circular configuration, thus assuring the intended fracture of bridges 22.

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the scope of the claims.

What is claimed is:

1. A tamper-indicating plastic closure for an associated container having an annular locking ring, comprising:

a closure cap including a circular top wall portion and a depending, generally cylindrical skirt portion;

a pilfer band depending from said cylindrical skirt portion;

fracturable means at least partially detachably connecting said pilfer band to said skirt portion, said pilfer band including interference means engageable with the locking ring said associated container during application of said closure to said container so that said pilfer band is deformed to minimize stress exerted on said fracturable means, said interference means being further engageable with said container locking ring during removal of said closure from said container so that said fracturable means are progressively stressed in a direction circumferentially of said closure, to thereby at least partially detach said pilfer band from said skirt portion; and centering means engageable with the locking ring of said associated container during removal of said closure therefrom for maintaining said pilfer band in a circular configuration.

2. A tamper-indicating plastic closure in accordance with claim 1, wherein said fracturable means comprises a plurality of circumferentially spaced fracturable bridges, said interference means progressively stressing said fracturable means so that said bridges are serially fractured.

3. A tamper-indicating plastic closure in accordance with claim 1, wherein said interference means extends circumferentially about the inner surface of said pilfer band in a plane extending at an acute angle to the vertical axis of said closure.

4. A tamper-indicating plastic closure in accordance with claim 1, wherein said centering means comprise a plurality of circumferentially spaced centering ribs positioned on the inner surface of said pilfer band above said interference lip.

5. A tamper-indicating plastic closure for an associated container having an annular locking ring, comprising:

a closure cap including a circular top wall portion and a depending, generally cylindrical skirt portion having an internal thread formation;

an annular pilfer band depending from said cylindrical skirt portion;

fracturable means at least partially detachably connecting said pilfer band to said skirt portion, said fracturable means comprising a plurality of spaced apart fracturable bridges;

said pilfer band means including interference lip means extending circumferentially substantially completely about the inner surface of said pilfer band, said interference lip means being engageable with the locking ring of said associated container during application of said closure to said container to deform said pilfer band to a non-circular configuration and thereby minimize stress exerted on said fracturable bridges, said interference lip means being further engageable with the locking ring of said container during removal of said closure therefrom so that said fracturable means are progressively stressed, in a direction circumferentially of said closure, to thereby serially fracture said fracturable bridges;

said interference lip means extending about the inner surface of said pilfer band in a single plane intersecting said pilfer band and extending at an acute angle to the vertical axis of said closure.

6. A tamper-indicating plastic closure in accordance with claim 5, wherein said plane extends at an acute angle in the range of about one degree to about five degrees relative to the vertical axis of said closure.

7. A tamper-indicating plastic closure in accordance with claim 5, wherein said interference lip means extend continuously about the inner surface of said pilfer band.

8. A tamper-indicating plastic closure in accordance with claim 5, including centering means engageable with the locking ring of said associated container during removal of said closure therefrom for maintaining said pilfer band in a circular configuration.

9. A tamper-indicating plastic closure in accordance with claim 5, wherein said pilfer band includes centering means engageable with the locking ring of said associated container during removal of said closure therefrom for maintaining said pilfer band in a circular configuration, said centering means comprising a plurality of circumferentially spaced centering ribs positioned on the inner surface of said pilfer band above said interference lip means.

10. A tamper-indicating plastic closure in accordance with claim 5, wherein said fracturable bridges are formed of uniform size.

11. A tamper-indicating plastic closure for an associated container having an annular locking ring, comprising:

a closure cap including a circular top wall portion and a depending, generally cylindrical skirt portion;

a pilfer band depending from said cylindrical skirt portion; and fracturable means at least partially detachably connecting said pilfer band to said skirt portion, said pilfer band including interference means extending circumferentially about the inner surface of said pilfer band in a plane extending at an acute angle to the vertical axis of said closure, said interference means comprising a continuous interference lip extending about the inner surface of said pilfer band, said interference means being engageable with the locking ring of said associated container during application of said closure to said container so that said pilfer band is deformed to minimize stress exerted on said fracturable means, said interference means being further engageable with said container locking ring during removal of said closure from said container so that said fracturable means are progressively stressed in a direction circumferentially of said closure, to thereby at least partially detach said pilfer band from said skirt portion.

12. A tamper-indicating plastic closure in accordance with claim 11, including centering means engageable with the locking ring of said associated container during removal of said closure therefrom for maintaining said pilfer band in a circular configuration.

13. A tamper-indicating plastic closure for an associated container having an annular locking ring, comprising:

a closure cap including a circular top wall portion and a depending, generally cylindrical skirt portion having an internal thread formation;

an annular pilfer band depending from said cylindrical skirt portion;

fracturable means at least partially detachably connecting said pilfer band to said skirt portion, said fracturable means comprising a plurality of spaced apart fracturable bridges;

said pilfer band means including interference lip means extending circumferentially about the inner surface of said pilfer band in a plane extending at an acute angle to the vertical axis of said closure, said interference lip means extending continuously about the inner surface of said pilfer band, said interference lip means being engageable with the locking ring of said associated container during application of said closure to said container to deform said pilfer band to a non-circular configuration and thereby minimize stress exerted on said fracturable bridges, said interference lip means being further engageable with the locking ring of said container during removal of said closure therefrom so that said fracturable means are progressively stressed, in a direction circumferentially of said closure, to thereby serially fracture said fracturable bridges.

14. A tamper-indicating plastic closure in accordance with claim 13, including centering means engageable with the locking ring of said associated container during removal of said closure therefrom for maintaining said pilfer band in a circular configuration.

15. A tamper-indicating plastic closure for an associated container having an annular locking ring, comprising:

a closure cap including a circular top wall portion and a depending, generally cylindrical skirt portion having an internal thread formation;

an annular pilfer band depending from said cylindrical skirt portion;

fracturable means at least partially detachably connecting said pilfer band to said skirt portion, said fracturable means comprising a plurality of spaced apart fracturable bridges;

said pilfer band means including interference lip means extending circumferentially about the inner surface of said pilfer band, said interference lip means being engageable with the locking ring of said container during removal of said closure therefrom so that said fracturable means are stressed to thereby serially fracture said fracturable bridges, said pilfer band means further including centering means engageable with the locking ring of said associated container during removal of said closure therefrom for maintaining said pilfer band in a circular configuration.

16. A tamper-indicating plastic closure in accordance with claim 15, wherein said centering means comprises a plurality of circumferentially spaced centering ribs positioned on the inner surface of said pilfer band above said interference lip means.

* * * * *